US010548794B2

(12) United States Patent
Vu et al.

(10) Patent No.: US 10,548,794 B2
(45) Date of Patent: Feb. 4, 2020

(54) SURGICAL HEAD SUPPORT

(71) Applicants: An Vu, Fallbrook, CA (US); Anderson Vu, Fallbrook, CA (US)

(72) Inventors: An Vu, Fallbrook, CA (US); Anderson Vu, Fallbrook, CA (US)

( * ) Notice: Subject to any disclaimer, the term of this patent is extended or adjusted under 35 U.S.C. 154(b) by 1107 days.

(21) Appl. No.: 14/858,464

(22) Filed: Sep. 18, 2015

(65) Prior Publication Data

US 2017/0079863 A1 Mar. 23, 2017

(51) Int. Cl.
*A61G 13/12* (2006.01)

(52) U.S. Cl.
CPC ..... *A61G 13/121* (2013.01); *A61G 13/1295* (2013.01); *A61G 2200/325* (2013.01)

(58) Field of Classification Search
CPC ..... A61G 15/12–125; A61G 1/04; A61G 13/12–1215; A61G 13/126–1295; A61G 7/065–072; A47C 7/36–383; A47C 20/00; A47C 20/02; A47C 20/026; A47G 9/10–1063; A61F 5/37; A61F 5/3707
See application file for complete search history.

(56) References Cited

U.S. PATENT DOCUMENTS

| | | | | | |
|---|---|---|---|---|---|
| 3,828,377 | A * | 8/1974 | Fary, Sr. | A47C 20/026 | 297/392 |
| 4,752,064 | A * | 6/1988 | Voss | A61G 13/12 | 5/622 |
| 4,777,802 | A * | 10/1988 | Feher | A47G 9/0215 | 5/423 |
| 5,220,699 | A * | 6/1993 | Farris | A47C 20/00 | 5/636 |
| 7,736,348 | B2 * | 6/2010 | Booth | A61F 5/56 | 128/845 |
| 2007/0163049 | A1 * | 7/2007 | Brinkerhoff | A61G 13/12 | 5/637 |
| 2009/0093685 | A1 * | 4/2009 | Vu | A61B 5/1106 | 600/300 |

* cited by examiner

*Primary Examiner* — Keri J Nelson
*Assistant Examiner* — Michelle J Lee
(74) *Attorney, Agent, or Firm* — John R. Ross, III

(57) ABSTRACT

A surgical head support device. A head cushion supports the patient's head while the patient is lying in the prone position during surgery. An air conditioning unit is adjacent to the head cushion and provides temperature control to the head cushion. A camera is positioned for viewing the patient's face as the patient is lying in the prone position on the head cushion. A secretion container is positioned to collect discharge from the patient's nose and mouth as the patient is lying in the prone position on the head cushion. A support platform is positioned under the head cushion and provides support for the head cushion, the camera and the secretion container. A height adjustment device is positioned under the support platform and is utilized to adjust the height of the head cushion for the safety and comfort of the patient.

9 Claims, 12 Drawing Sheets

SURGICAL HEAD SUPPORT

The present invention relates to surgical devices, and in particular, to head supports for patients to be used during surgery.

BACKGROUND OF THE INVENTION

Head and face support devices are known in the prior art and are utilized to support a patient's head while he is lying in the prone position (face down) during surgery. If the patient is not properly supported the patient could be injured or he could have difficulty breathing. Previous attempts in the prior art have failed to provide optimal protection, safety and comfort for the patient.

Many surgical devices meant for head comfort contain polyurethane foams and various amounts of hardware meant for patient safety. Polyurethane can still leave dermatologic abrasions under certain conditions. These skin injuries are mainly due to inconsistent softness of the polyurethane foam itself. Additionally, many supplementary devices utilized along with the foams become ineffective under particular circumstances.

U.S. Pat. Nos. 6,637,058, 4,752,064, 5,269,035, and 5,613,501 illustrate various cushions meant to be utilized in prone position surgeries. These patents all contain center cavities that leave the eyes, nose, and mouth exposed, and also incorporate space to route endotracheal tubing. However, these patents do not accommodate for viewing the patient's face. Furthermore, these polyurethane foams contain variable densities, indentation load deflections, and softness that induce pressure upon the patient's face to cause abrasions.

Also, prior art methods of protecting the patient's face include attaching safety goggles to the patient's head. The lenses of these goggles are simple and mostly made of plastics. Movement of the patients during procedures can dent these lenses and induce pressure directly to the eyelid or eye, and thus lead to soft tissue damage.

U.S. Pat. Nos. 6,490,737, 6,842,924 and 8,549,683 describe the ability to monitor the patient's face through the use of a minor attached to the casing of the foam cushion. Even though this approach is simple and somewhat functional, the anesthesiologist or surgeon must orient themselves in various positions round the operating table in order to fully conduct proper observation of the patient's face. On some occasions the patient's head is covered with a blanket, and therefore the mirror is unable to reflect the patient's face.

Additionally, in the prone position, excess fluids that come from the patient's nasal or oral cavities can possibly contaminate other tools and instruments in the operating room. Therefore it is imperative that the accumulation of nasal and oral secretions be contained. None of the patents accommodate for these fluids, and thus excess sanitation procedures must be taken to eliminate possible sources of infection.

What is needed is an improved head support device for supporting a patient's head while lying in the prone position during surgery.

SUMMARY OF THE INVENTION

The present invention provides a surgical head support device. A head cushion supports the patient's head while the patient is lying in the prone position during surgery. An air conditioning unit is adjacent to the head cushion and provides temperature control to the head cushion. A camera is positioned for viewing the patient's face as the patient is lying in the prone position on the head cushion. A secretion container is positioned to collect discharge from the patient's nose and mouth as the patient is lying in the prone position on the head cushion. A support platform is positioned under the head cushion and provides support for the head cushion, the camera and the secretion container. A height adjustment device is positioned under the support platform and is utilized to adjust the height of the head cushion for the safety and comfort of the patient.

DETAILED DESCRIPTION OF THE PREFERRED EMBODIMENTS

Figure 11A:
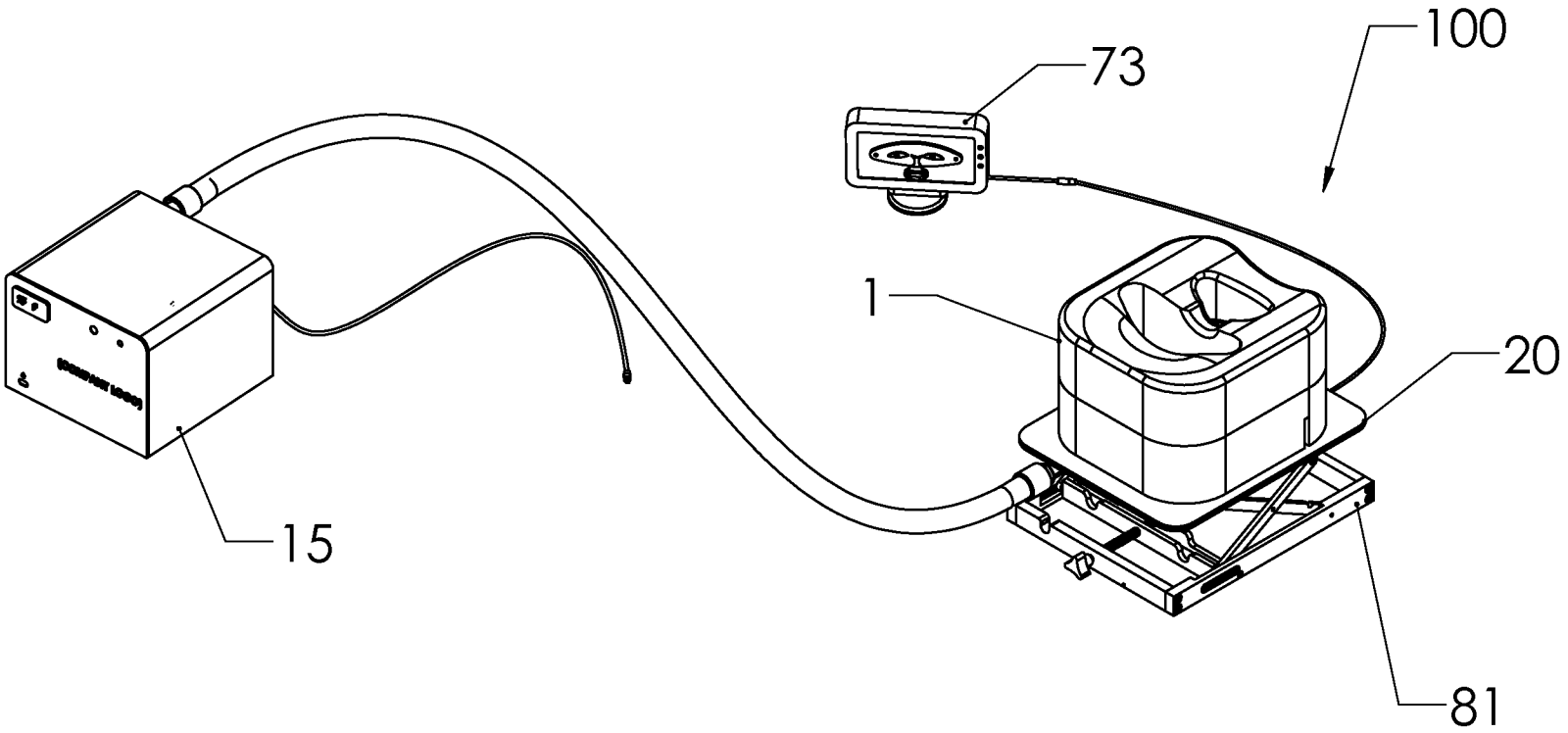
FIGS. 11A-11B show a preferred embodiment of the present invention.
Figure 11B:
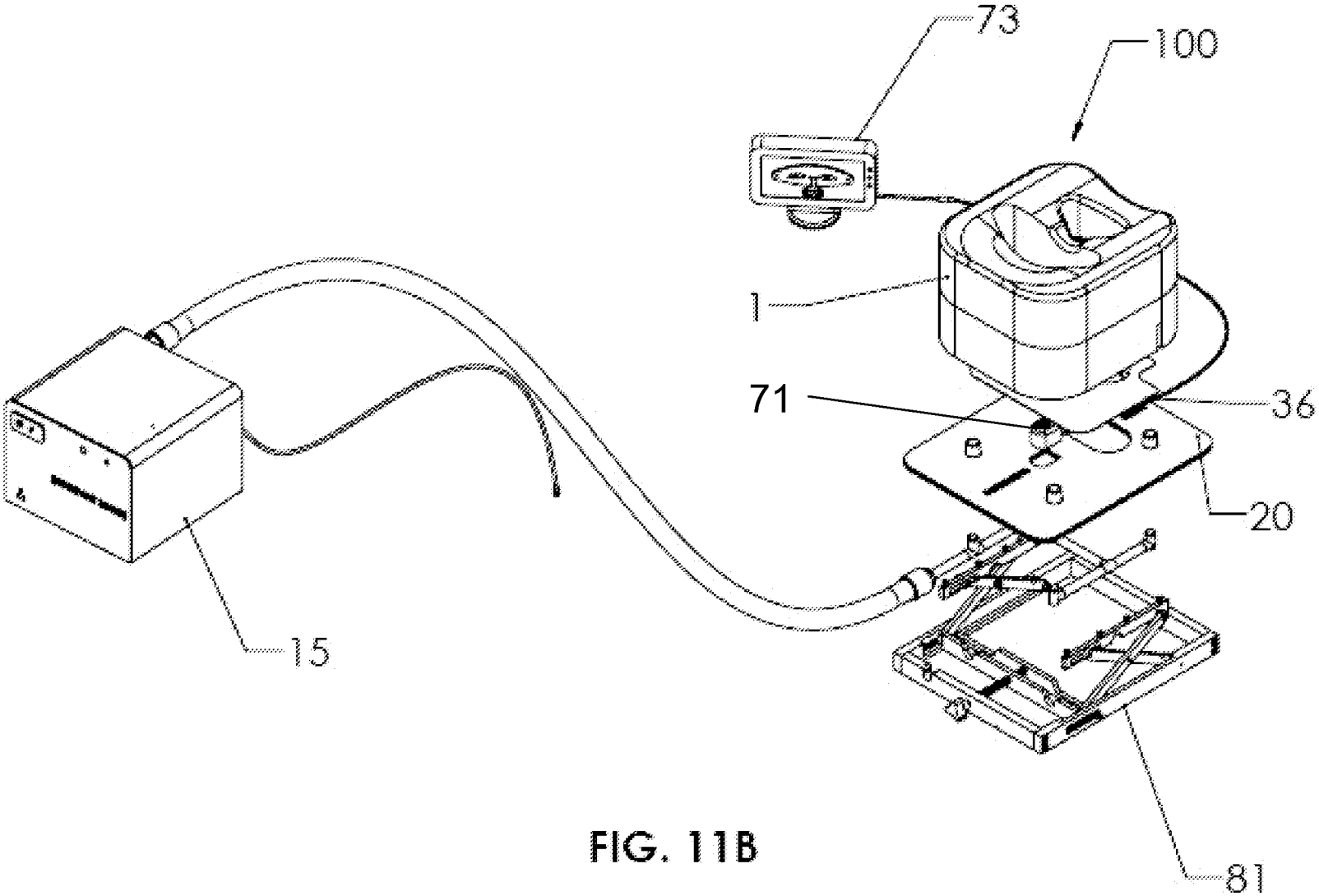

FIGS. 11A-11B show a preferred embodiment of the patient head support 100. A patient lying face down places his head onto face cushion 1 for support. Air conditioning unit 15 provides cool air or warm air to face cushion 1, as appropriate for patient comfort. Camera 71 is mounted below face cushion 1 and transmits a monitor signal to screen 73 for patient monitoring during surgery. Patient head support 100 also includes a secretion container for collection of discharge from the patient's mouth and nose during surgery. The height of face cushion 1 is adjusted by utilization of height adjustment mechanism 81 to the optimum level for the patient.

Face Cushion

Figure 9:
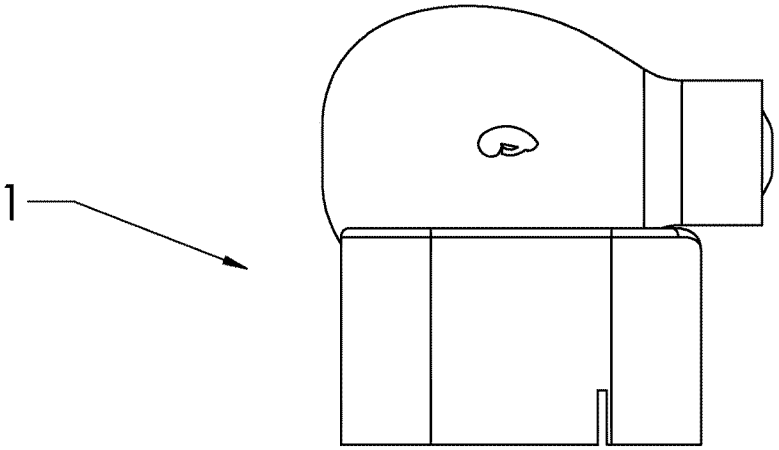
FIGS. 9 and 10 show the patient's face in the prone position.

Face cushion 1 is utilized to provide support and comfort to a patient's face as he is lying face down for surgery. In a preferred embodiment, face cushion 1 includes upper cushion 5 (FIG. 2A), visual lens 8 and bottom cushion 9 that are each bonded together to function as described below. FIG. 9 shows a side view of a patient lying in the prone position on face cushion 1.

Upper Cushion

Figure 1:
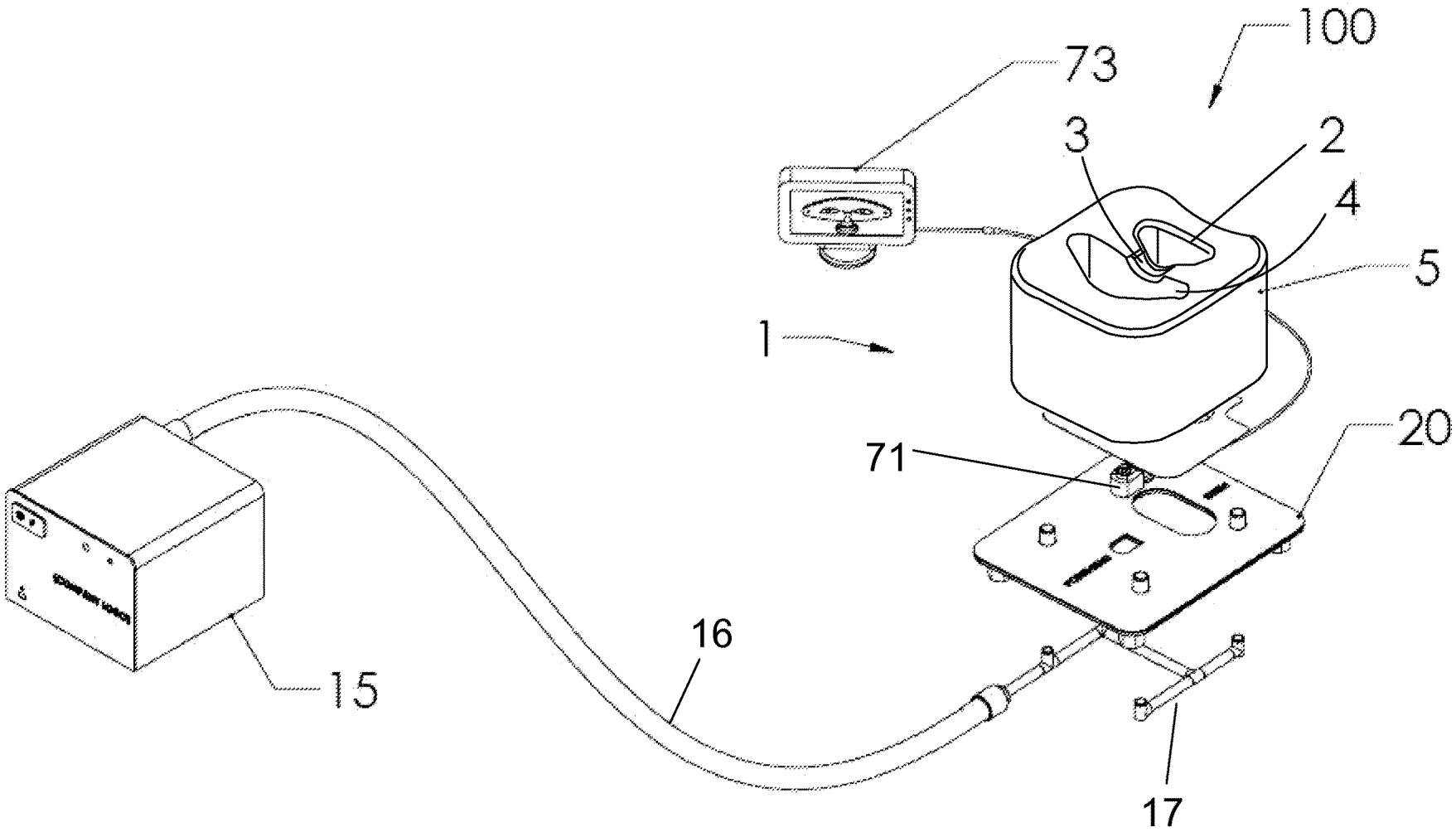
FIG. 1 shows an exploded view of a preferred embodiment of the present invention.
Figure 2A:
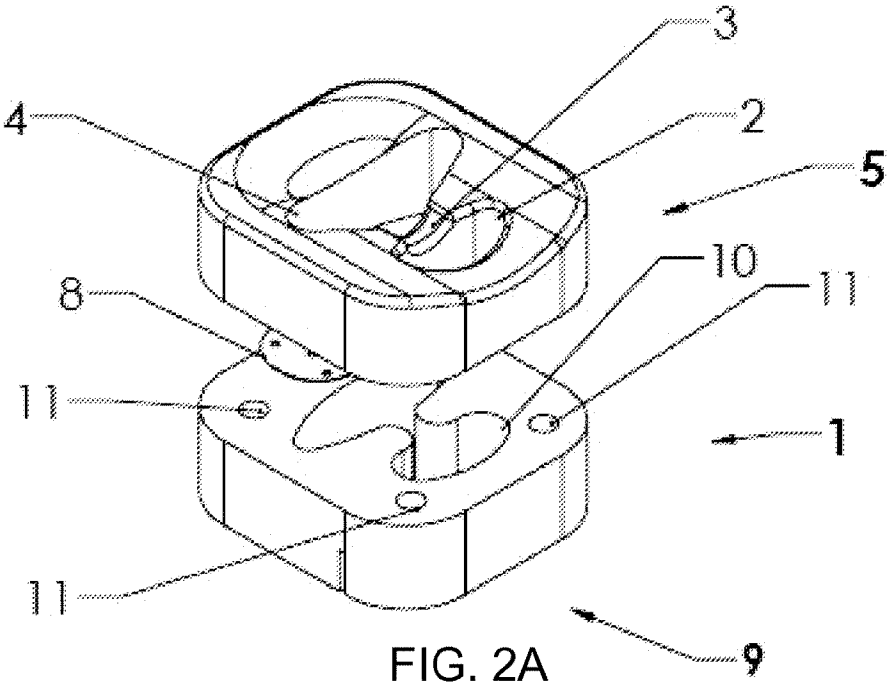
FIG. 2A shows a preferred head cushion.

In a preferred embodiment of the present invention face cushion 1 includes upper cushion 5 (FIG. 2A). The patient's head is directly supported by upper cushion 5. Upper cushion 5 is preferably fabricated from visco-elastic foam, also known as memory foam. Memory foam permits upper cushion 5 to deform easily to the unique contours of each patient's face. The memory foam then quickly and easily returns to its original shape after the patient's face is lifted. Upper cushion 5 also includes mouth cutout section 2, nose indentation section 3 and eye cutout section 4 (see also FIG. 1). Mouth cutout section 2 allows a pathway for oral and nasal discharge. Nose indentation 3 conforms to the top of the user's nose and eye cutout section 4 allows for visual monitoring of the patient's eyes.

Visual Lens

Figure 4:
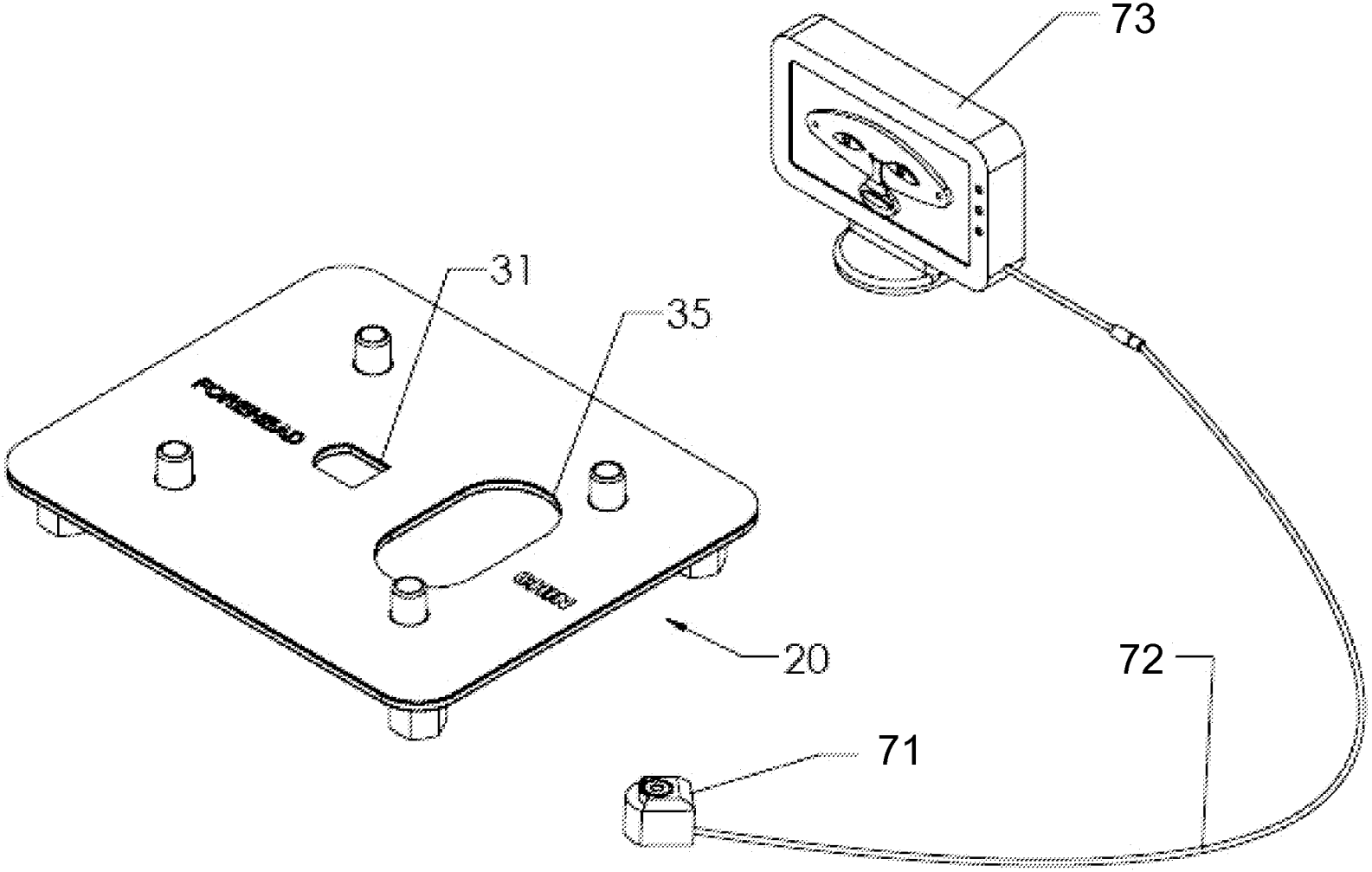
FIG. 4 shows a preferred camera and monitor screen.

Visual lens 8 is positioned under eye cutout section 4 of upper cushion 5. In a preferred embodiment, visual lens 8 is approximately 0.005 inch to 0.030 inch in thick and is fabricated from clear plastic. Visual lens 8 functions to prevent foreign matter below lens 8 from coming in contact with the patient's eyes while simultaneously allowing for observation of the patient's eyes by utilization of camera 71 (FIG. 4). Visual lens 8 also functions to hold upper cushion 5 in place laterally as the patient is resting his head on upper cushion 5. Holes 8C allow upper cushion 5 to bond with bottom cushion 9 through visual lens 8. Then, visual lens 8 is able to prevent lateral expansion of upper cushion 5.

Figure 2B:
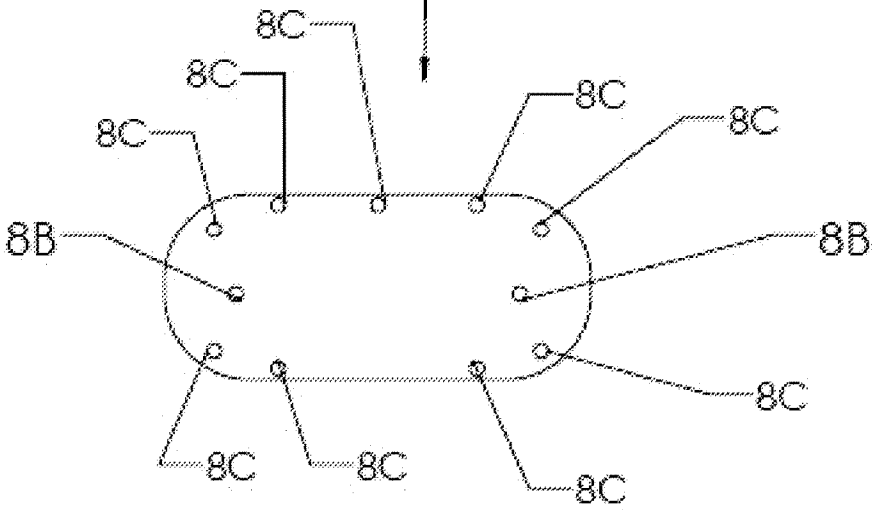
FIG. 2B shows a preferred visual lens.

Visual lens 8 includes very small holes 8B (FIG. 2B) to relieve pressure and condensation that may build up during surgical procedures. When lying face down on the cushion, the area between the face and lens makes a semi-closed system, and any heat or air input can build condensation or pressure, respectively.

Bottom Cushion

Figure 10:
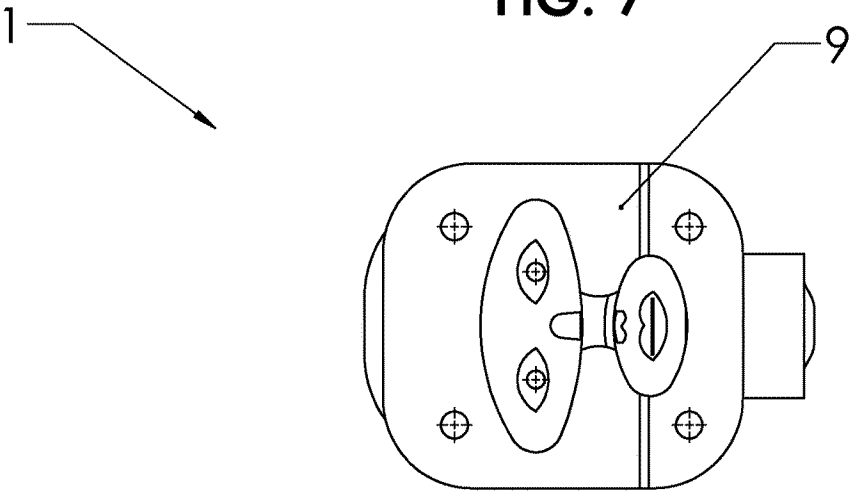

Bottom cushion 9 is positioned below visual lens 8 and upper cushion 5. Bottom cushion 9 is more stiff than upper cushion 5 so bottom cushion 9 is able to assist in maintaining the structure of face cushion 1 during usage. Bottom cushion 9 includes cutout section 10. Cutout section 10 aligns with mouth cutout section 2 and eye cutout section 4 from upper cushion 5. Cutout section 10 allows visual access to the patient's eyes and also allows for a pathway for discharge from a patient's nose and mouth. Holes 11 allow a pathway for airflow from air conditioning unit 15 to provide adequate temperature control for face cushion 1. In a preferred embodiment bottom cushion 9 is fabricated from open-cell polyurethane of ILD 40 to 60 lbs and 25% compression per ASME standards. Bottom cushion 9 preferably has a density range of 2.0 to 3.5 cubic feet/pound. FIG. 10 shows a view looking upwards from below bottom cushion 9 of the patient's face supported by face cushion 1.

Platform

Figure 5A:
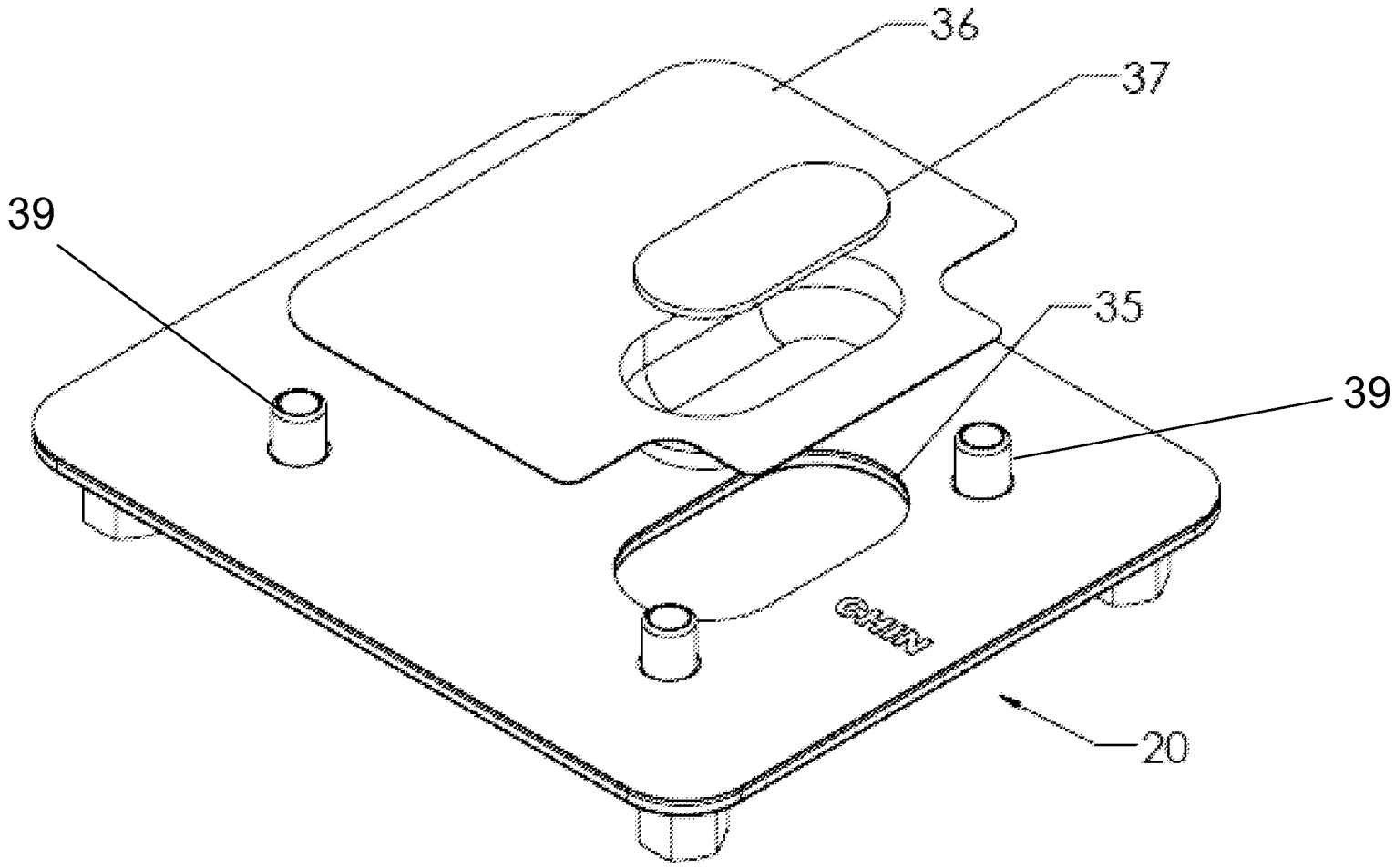
FIGS. 5A-5B show a preferred secretion container.
Figure 5B:
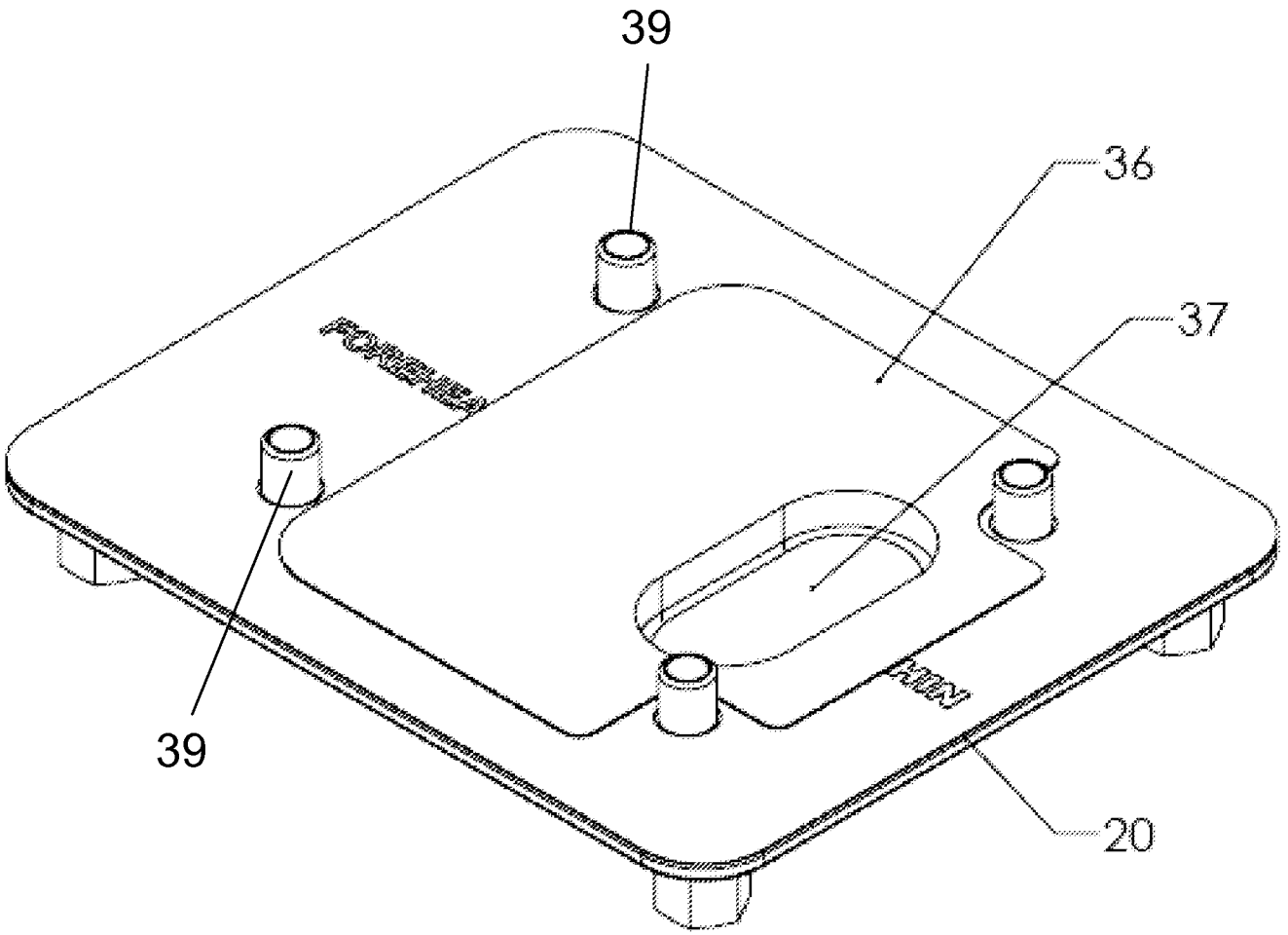

Cushion 1 rests on platform 20 (FIG. 1). Platform 20 (FIG. 3) includes small cavity 31 for holding monitor camera 71 (FIG. 4). Camera 71 transmits video and audio transmission of the patient's face to monitor screen 73 via cable 72. In this fashion, the patient can be carefully monitored during surgery by viewing monitor screen 73. Platform 20 also includes large cavity 35. Large cavity 35 holds secretion container 36 (FIGS. 5A, 5B). Secretion container 36 is a thin plastic container that sits on top of platform 20. Secretion container 36 preferably includes secretion absorption pad 37 for absorbing discharge from the patient's mouth and nose during surgery. Platform 20 also includes four airflow openings 39 that permit airflow from AC unit 15 to face cushion 1.

Air Conditioning Unit

Air conditioning unit 15 is connected to platform 20 via airflow tube 16 and air ducts 17 (FIG. 1). Air conditioning unit 15 transmits cool air to face cushion 1. Air conditioning unit 15 in conjunction with a heating blanket operates to adjust the body to optimal temperatures so that there is sufficient blood flow to all parts of the body, including the patient's face. Additionally, the air conditioning unit 15 can be used to remove heat from face cushion 1 to reduce facial temperatures without the use of Freon.

Air conditioning unit 15 automatically adjusts the temperature when needed, so no user input is necessary after the ideal body temperature is set, unless other circumstances require the reduction or elevation of heat flow. Air conditioning unit 15 preferably remains adjacent to face cushion 1 and is connected by airflow tube 16 to air ducts 17 to cool or heat face cushion 1.

Figure 6:
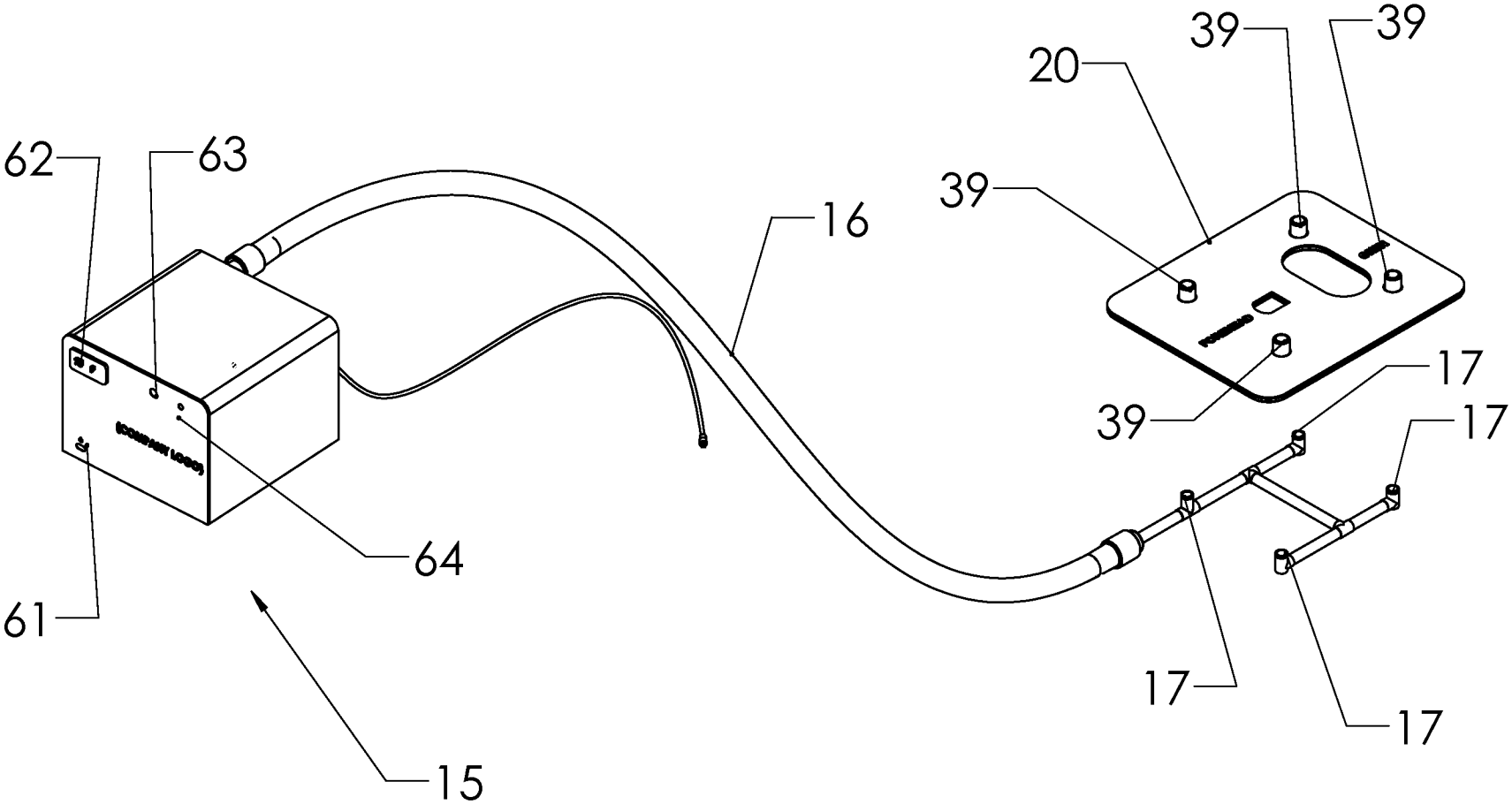
FIG. 6 shows a preferred air conditioning unit.

In a preferred embodiment of the present invention, air conditioning unit 15 is a thermoelectric air conditioning unit. Thermoelectric air conditioning unit 15 utilizes the Peltier phenomenon, having two dissimilar semiconductors that generate or absorb heat based on the applied voltage. By reversing the polarity of the applied voltage, unit 15 may be used to heat or cool as desired. FIG. 6 shows a preferred air conditioning unit 15. Air conditioning unit 15 includes power switch 61, temperature controller 62, power indicator 63, air conditioning "on" indicator 64, airflow tube 16 and air ducts 17. The fan in air conditioning unit 15 can be adjusted so that the air flow through air flow tube 16 is adjustable by one to ten cubic feet per minute. Air ducts 17 connect to air flow openings 39 of platform 20 to deliver air flow to holes 11 of bottom cushion 9 to heat or cool face cushion 1. Bottom cushion 9 and upper cushion 5 are porous so they allow the flow of air through the porous foams and eventually to the patient's face.

Remote Camera Monitor

Figure 7:
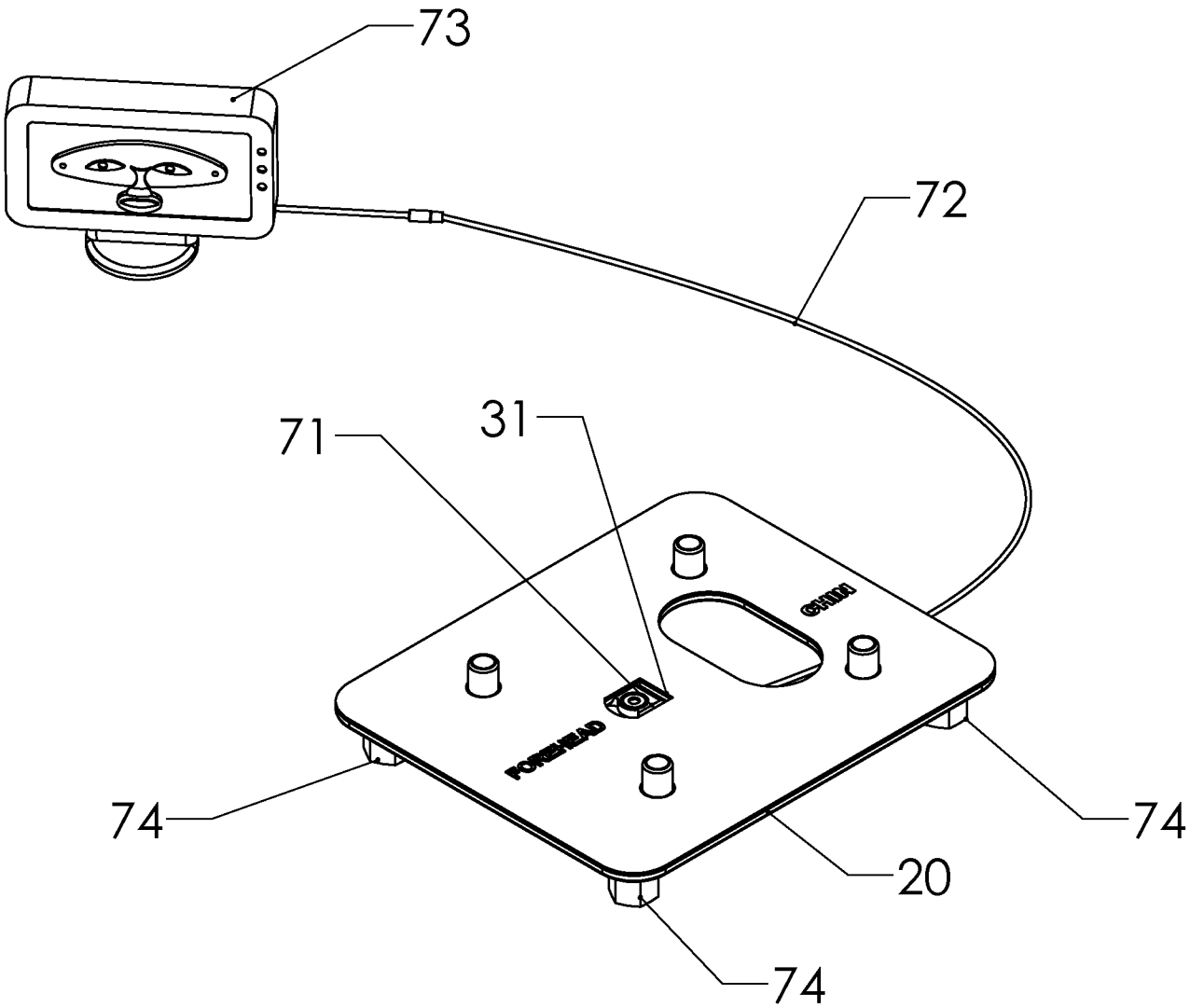
FIG. 7 shows a preferred camera connected to the platform.

FIGS. 4 and 7 shows remote camera 71 connected via cable 72 to monitor and control screen 73. Camera 71 senses and transmits video and audio signals to screen 73 for monitoring during surgery. In a preferred embodiment, camera 71 is camera part no. WP-CT04IRA-E manufactured by the Wekomp Corporation. Camera 71 is mounted to platform 20 so that its lens is directed upward to the eyes of the patient. Accordingly, the patient is monitored during the surgery so that important video and audio information may be observed on screen 73 by the surgeon or anesthesiologist. Camera 71 is removable from platform 20 for the purposes of cleaning or adjustment. Camera 71 faces upward and captures video and audio information from eye cutout section 4 of face cushion 1. In another preferred embodiment, the signals from camera 71 are transmitted to screen 73 via a wireless transmitter. In another preferred embodiment, signals from camera 71 may be wirelessly transmitted to a personal computing device such as a smart phone, a laptop computer or a mobile tablet application. Preferably, the audio and video signals may be saved in digital format onto a hard drive or removable memory card.

Secretion Container

FIG. 5A shows secretion container 36 and secretion absorption pad 37 positioned above large cavity 35 of platform 20. FIG. 5B shows secretion absorption pad 37 resting in secretion container 36. Secretion container 36 is resting on top of platform 20 as shown. Secretion container 36 collects oral and nasal discharge from the patient as he is lying in the prone position and positioned over face cushion 1. Secretion container 36 holding absorption pad 37 is placed on top of platform 20 prior to the surgery. Preferably, secretion container 36 is fabricated from plastic and is approximately 0.005 inch to 0.020 inch thick. Absorption pad 37 ensures that the accumulation of fluid discharge from the patient remains stationary and does not contaminate the reusable components of support device 100 and other nearby objects.

Height Adjustment Mechanism

Figure 8:
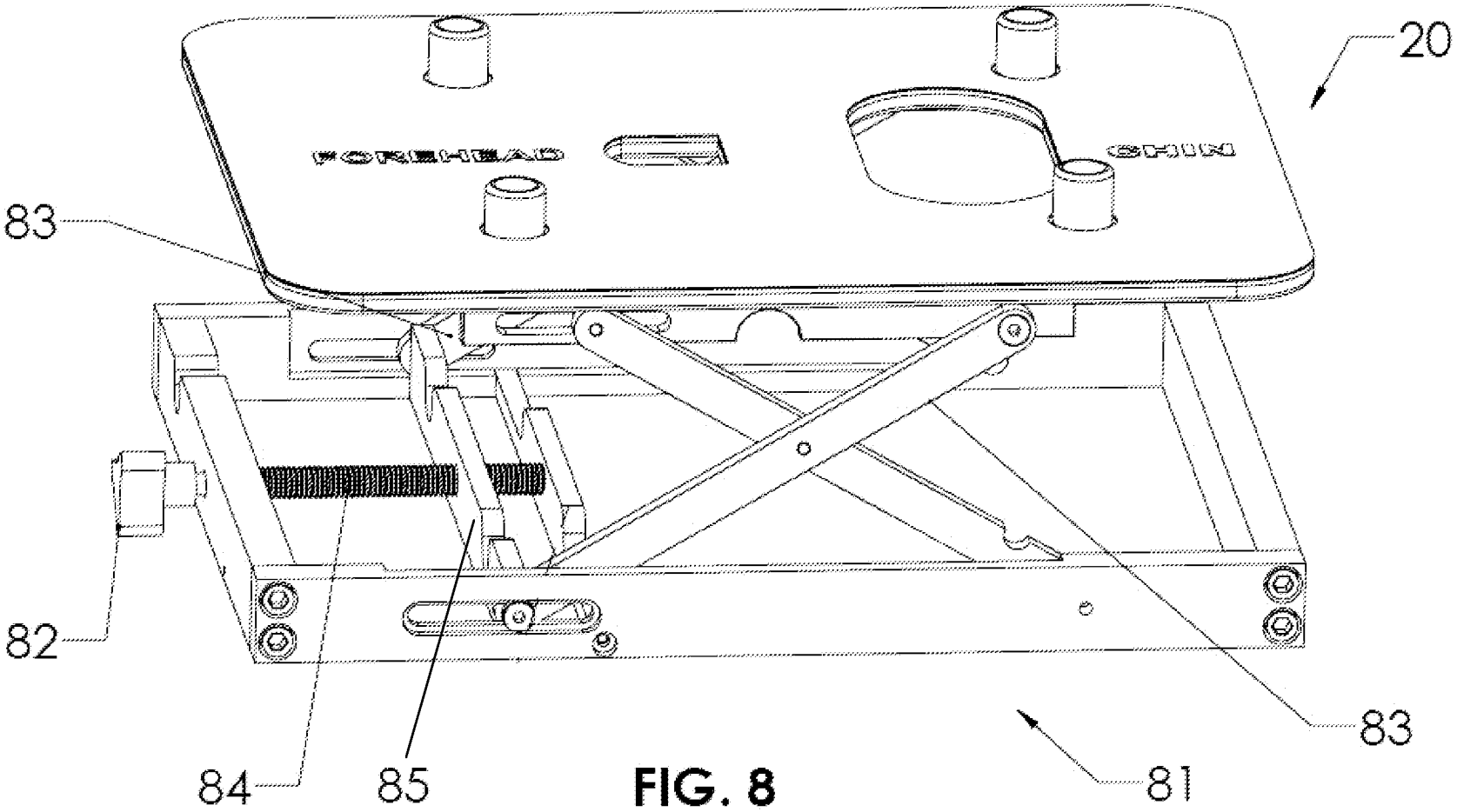
FIG. 8 shows a preferred height adjustment mechanism.

FIG. 8 shows height adjustment mechanism 81. Platform 20 is connected to the top of height adjustment mechanism 81. The height of height adjustment mechanism 81 is adjusted by turning knob 82. The height can be adjusted 4 inches vertically. Height adjustment mechanism 81 utilizes two collapsible x-beams 83 on each side to raise and lower platform 20. As knob 82 is turned adjustment piece 85 moves horizontally causing x-beams 83 to narrow or widen. This causes the height of platform 20 to accordingly increase or decrease. In another preferred embodiment knob 20 is turned by the use of a motor to increase ease of use.

Alternate Height Adjustment Mechanism

Figure 3:
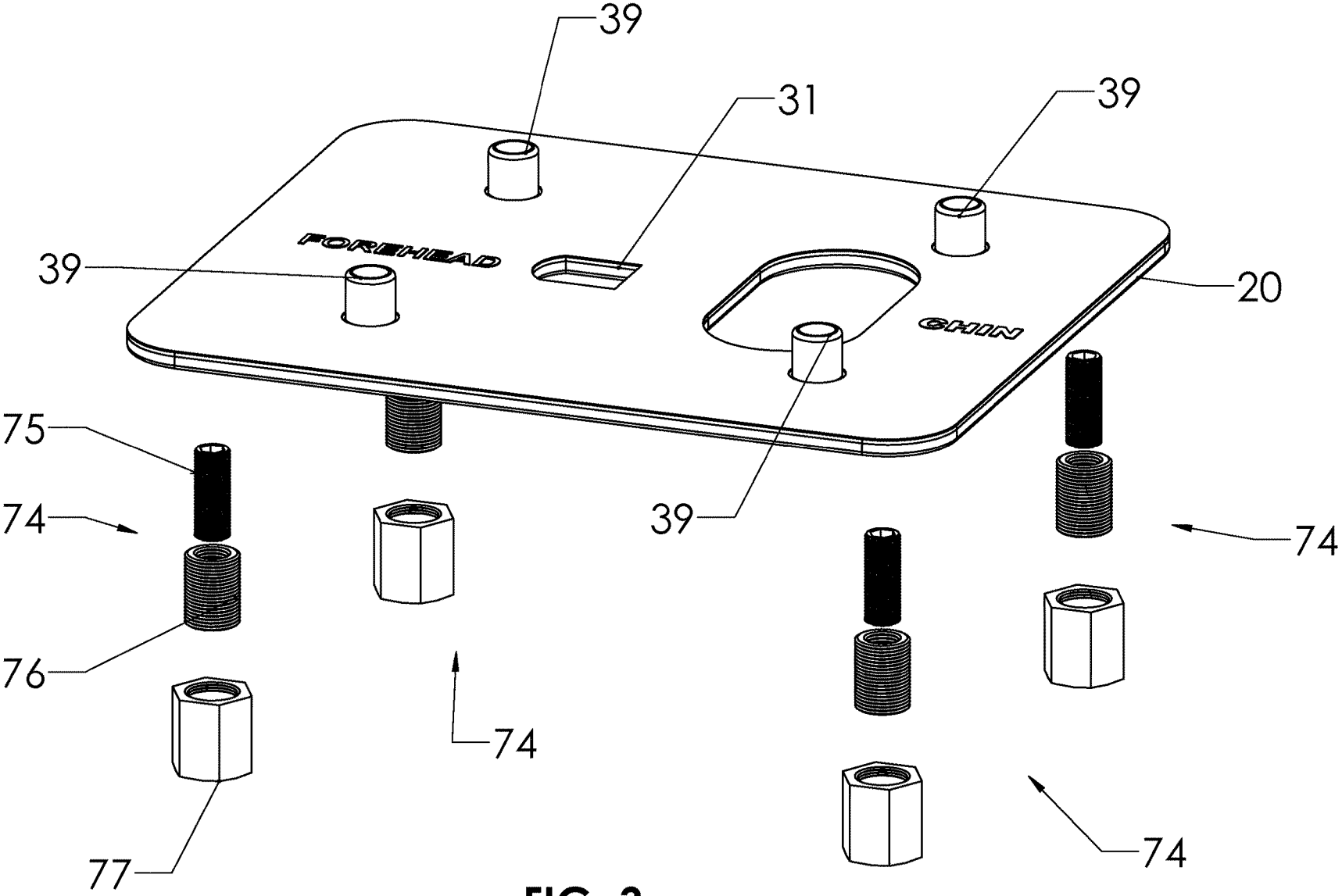
FIG. 3 shows a preferred platform.

FIG. 3 shows an exploded view of an alternate height adjustment mechanism. Height adjustment screws 74 are threaded into the bottom of platform 20 also as shown in FIG. 7. Preferably, each height adjustment screw 74 includes set screw 75 tightly attached to platform 20. Intermediate screw 76 includes internal and external threads and is threaded onto set screw 75. Nut 77 is threaded onto intermediate screw 76. Accordingly, platform 20 can be adjusted two inches vertically by turning height adjustment screws 74.

- - -

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A surgical head support device, comprising:

A. a head cushion for supporting a patient's head while lying in a prone position during surgery, said head cushion comprising:
  i. an upper cushion comprising:
    a. an eye cutout section,
    b. a nose indentation section,
    c. a mouth cutout section,
  ii. a visual lens positioned beneath said eye cutout section, and
  iii. a bottom cushion positioned beneath said visual lens and said upper cushion, said bottom cushion comprising:
    a. a bottom cutout section to align with said eye cutout section and said mouth cutout section,
    b. air flow holes to receive air flow from an air conditioning unit, said air conditioning unit adjacent to said head support and for providing temperature control to said head cushion, B. a camera positioned for viewing the patient's face as the patient is lying in the prone position on said head cushion, C. a secretion container for collecting discharge from the patient's nose and mouth as the patient is lying in the prone position on said head cushion, D. a support platform positioned under said head cushion, said support platform for supporting said head cushion, said camera and said secretion container, said bottom cushion positioned on said support platform, and E. a height adjustment device positioned under said support platform, said height adjustment device for adjusting height of said head cushion.

2. The surgical head support as in claim 1, wherein said upper cushion is fabricated from memory foam.

3. The surgical head support as in claim 1, wherein said air conditioning unit is a thermoelectric air conditioning unit, comprising:

A. a hose connecting said air conditioning unit to said head cushion, and

B. at least one air duct connected to said hose and for transferring air flow to said head cushion.

4. The surgical head support as in claim 1, wherein said secretion container comprises an absorption pad and is position under said mouth cutout section of said head cushion.

5. The surgical head support as in claim 1, wherein said support platform comprises:

A. a camera cavity for holding said camera,

B. a secretion container cavity for holding said secretion container, and

C. at least one air duct for permitting air flow from said air conditioning unit to said head cushion.

6. The surgical head support as in claim 1, wherein said height adjustment device is hand adjustable.

7. The surgical head support as in claim 1, wherein said camera is removably attached to said support platform and faces upwards through said visual lens, wherein said camera further comprises a remote monitor, wherein said camera is configured to transmit visual and audio signals to said remote monitor.

8. The surgical head support as in claim 1, wherein said height adjustment device comprises a plurality of user adjustable collapsible x-beams connected to said platform.

9. The surgical head support as in claim 1, wherein said height adjustment device comprises a plurality of height adjustment screws threaded onto said platform.

* * * * *